United States Patent [19]

Callet et al.

[11] 4,174,599

[45] Nov. 20, 1979

[54] BAGGING MACHINE FOR PACKAGING POWDERED MATERIALS

[75] Inventors: Robert Callet; Henri Jeantet, both of Chaumont, France

[73] Assignee: Societe Anonyme des Imprimerie et Papeterie de l'Est, Chaumont, France

[21] Appl. No.: 933,965

[22] Filed: Aug. 15, 1978

[30] Foreign Application Priority Data

Aug. 18, 1977 [FR] France ..... 77 25335

[51] Int. Cl.[2] ..... B65B 31/04; B65B 1/22; B65B 43/30

[52] U.S. Cl. ..... 53/512; 53/525; 53/570; 53/386; 141/75; 141/93

[58] Field of Search ..... 53/525, 527, 570, 571, 53/386, 512; 141/65, 75, 93, 313, 316

[56] References Cited

U.S. PATENT DOCUMENTS

| | | | |
|---|---|---|---|
| 2,900,774 | 8/1959 | Henriksen | 53/525 |
| 2,938,314 | 5/1960 | Hopkins | 53/386 |
| 3,225,514 | 12/1965 | Inglett | 53/573 |
| 3,851,444 | 12/1974 | Merat | 53/570 X |

FOREIGN PATENT DOCUMENTS 1586075 4/1970 Fed. Rep. of Germany .

*Primary Examiner*—Travis S. McGehee
*Attorney, Agent, or Firm*—Melville, Strassert, Frost & Jacobs

[57] ABSTRACT

An improved bagging machine for the packaging of powdered materials is provided which avoids soiling the lips of the bags with material which would interfere with the sealing of the bags. The bagging machine comprises a station for gripping and opening the bags having suckers connected to a vacuum source, a filling station including a product inlet chute connected to a measuring means, means for opening and closing the orifice of the chute and for inserting this orifice into the open mouth of the bags and for applying the lips of the latter sealingly against the chute. Means are provided for compacting the material and means for sucking out the air contained inside the bags being filled, a station for closing the bags by welding and/or sewing, means for holding the bags by suspension and for transferring them from one station to the next, and means for synchronizing and sequencing the various movements and operations are also provided. The bagging machine is particularly useful for the automatic filling of bags with powdered materials.

10 Claims, 14 Drawing Figures

BAGGING MACHINE FOR PACKAGING POWDERED MATERIALS

BACKGROUND OF THE INVENTION

1. Field of the Invention

The present invention relates to the field of packaging powdered products, notably into bags.

2. Description of the Prior Art

Powdered products or those having a high tendency to become mixed with air during operations of transportation and weighing pose problems in bagging, notably into bags of plastics material or of paper.

The proportion of air that they carry causes a considerable increase in their volume, which necessitates, in the majority of cases, the use of bags of greater capacity than would be required by the same product restored to its true density.

An attempt has already been made to resolve this problem by forming on bags of the "open mouth" type a hole in one of its surfaces at the level of the place where the closing of the bag would be effected by welding and/or sewing and by forming, on the bagging mouth of the filling or packaging machine, an air passage corresponding to that of the bag when the latter is held by the bag-holder, a vacuum pump sucking air mixed with the product during the whole time of filling, after which the said hole was hermetically closed simultaneously with the mouth of the bag.

However, such a device does not give complete satisfaction on account of the difficulty of maintaining the area of the bag intended to be sealed by welding free of particles of product due to the fact of the implantation of the vacuum applying system inside the bag during its filling. The lips of the bag intended to be welded remain in fact more-or-less polluted which spoils the quality of the welding.

It is an object of the invention to overcome this drawback by providing a machine for the bagging of powdered products in bags of the "open mouth" type of plastics material, the inside of the bag in the course of filling being subjected to pumping of the air entrained by the product, the bag welding areas being preserved from any contact with the product in the course of the bag-filling operation.

It is also an object of the invention to provide a machine ensuring complete automatization of the bagging process from the taking of the bag until its welding, the various operations being carried out at high speed and with great reliability.

GENERAL DESCRIPTION OF THE INVENTION

Accordingly, the invention provides a bagging machine for the packaging of powdered products into bags of the "open mouth" type, characterized in that it comprises a bag gripping and opening station of the "sucker" type connected to a source of vacuum, a bag-filling station comprising an inlet chute for the product connected to a measuring and/or weighing device, means to open and close the chute orifice, means for introducing this orifice into the open mouth of the bags and for applying the lips of the latter into sealed contact against said spout, means for compacting the product in the course of filling the bags and means for sucking air continuously inside the bags in the course of filling, a closing station for the bags by welding and/or sewing, means for holding the bags by suspension and for transfering them successively from one station to the next, and means for synchronizing and linking-up automatically the various movements and operations at the different stations.

BRIEF DESCRIPTION OF THE DRAWINGS

A preferred embodiment of such a machine according to the invention will now be described with reference to the accompanying drawings, in which.

DESCRIPTION OF PREFERRED EMBODIMENTS

Figure 1:
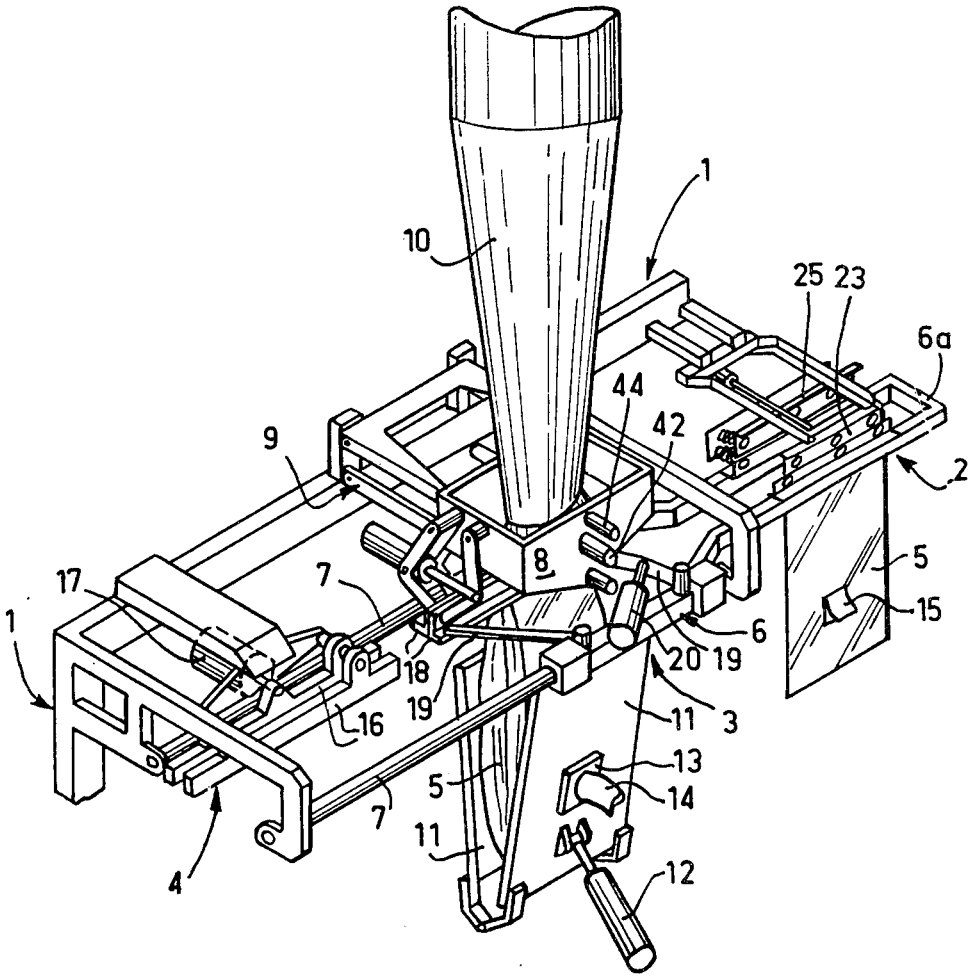
FIG. 1 is a partial diagrammatic view and in perspective of an embodiment of the machine according to the invention, a bag being in process of filling, whilst another bag is at the gripping and opening station.
Figure 2:
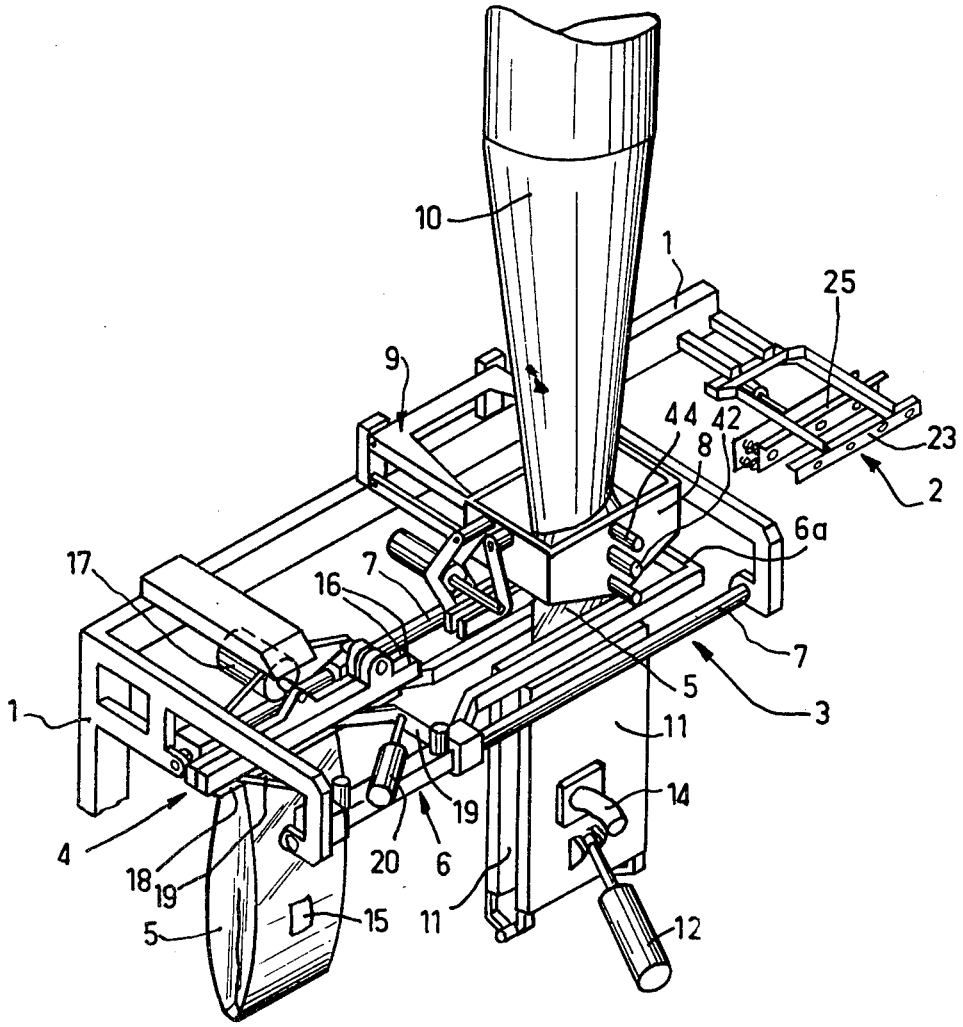
FIG. 2 is a view similar to that of FIG. 1, the filled bag of FIG. 1 having been transferred to the welding station and the other bag having been transferred to the bagging station.
Figure 3:
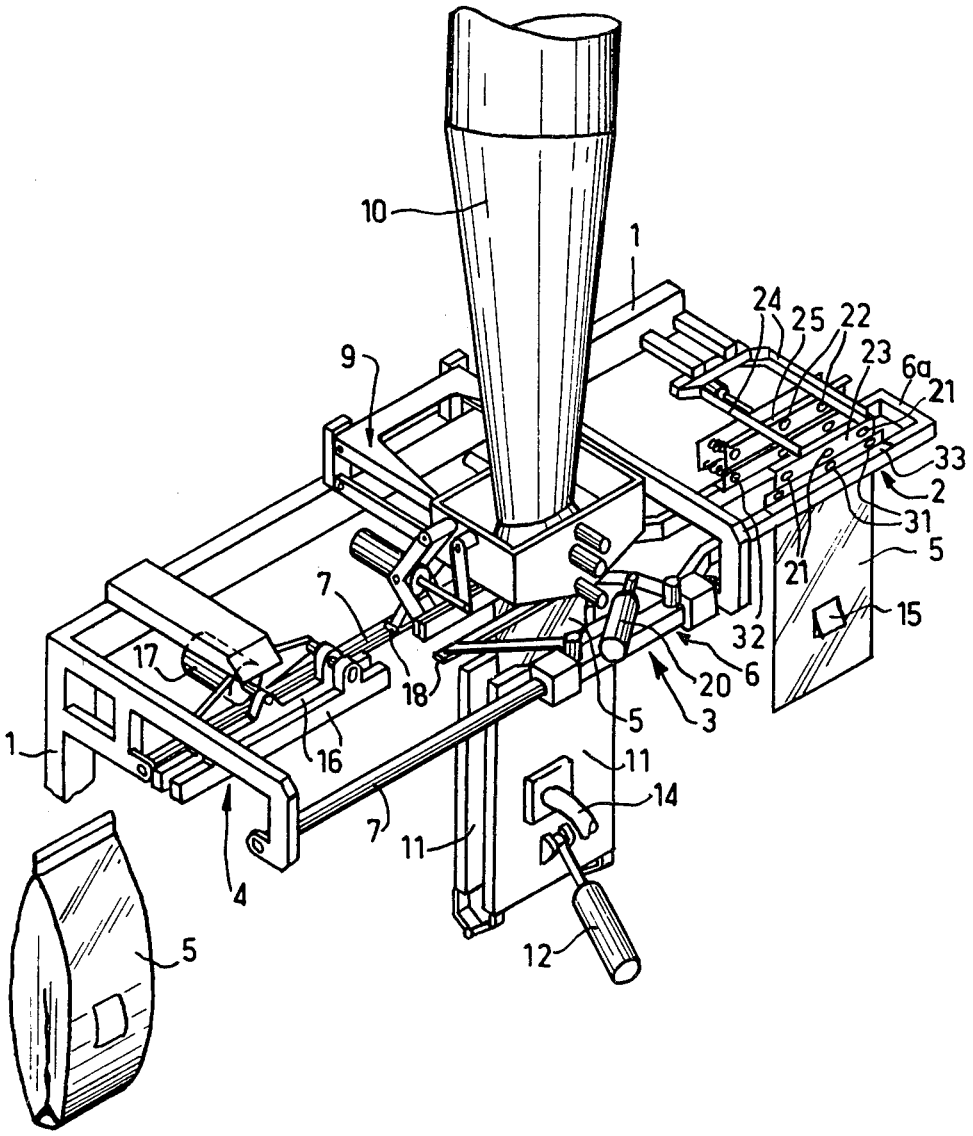
FIG. 3 is a view similar to those of FIGS. 1 and 2, the filled bag having been evacuated, the other bag being in the course of filling and the third bag being presented to the machine.

The machine shown diagrammatically in perspective view in FIGS. 1 to 3 comprises a base on which are arranged, from side to side, the bag gripping station 2, the bag filling station 3 and the bag welding station 4.

The bag gripping and opening station 2 for the lips of the bag 5 is conventional and comprises a set of suckers connected to a vacuum pump and of which certain ones remain at the station 2 whilst others are borne by a portion 6*a* in the form of a fork of a carriage 6 with a horizontal movement.

The station 2 will be described in more detail with reference to FIGS. 4 and 5.

The carriage 6 is displaceable along two parallel slides 7 borne by the base 1, under the control of a drive system (not shown) constituted for example, by an endless chain pulling the carriage 6 and two gear wheels borne by the base 1 and of which one is driven by an electric motor.

The part of the carriage 6 sliding on the slideway 7 can be moved between two end positions, one in which this part of the carriage 6 is at the station 3 (FIGS. 1 and 3) and the other in which it is at the station 4 (FIG. 2).

The fork shaped part 6 is overhanging with respect to the carriage 6 and is responsible for the transfer of the bag 5 from the station 2 (FIG. 1) to the station 3 (FIG. 2).

The filling station 3 comprises members for holding in open and fluid-tight position the lips of the bag 5, borne by a frame 8 movable vertically.

To this end, the frame 8 is mounted at the end of a deformable parallelogram 9 of which the other end is fixed to the base 1 and whose movement is ensured by a hydraulic or pneumatic jack not shown in FIGS. 1 to 3.

The lower end of a flexible chute 10 is imprisoned in the frame 8, the upper end being fixed to the lower part of a hopper of a measuring or weighing device (not shown).

In the axis of the chute 10, below the frame 8, is arranged a system of plates 11 movable relatively one towards the other and taking as a sandwich the bag 5 in the process of filling.

The plates 11 are pivoted at their lower part and driven by jacks 12. In addition, one of the plates 11 bears a vibrator (not shown) responsible for tamping the product in the bag 5.

Finally, the plate 11 not provided with a vibrator comprises in its central portion an orifice provided with a connector 13 intended to be joined through a flexible pipe 14 to a vacuum pump (not shown).

Said orifice is situated facing a filtering valve 15 with which the wall of each bag 5 is provided.

Bags equiped with such valves are well-known and will not be described here in more detail.

Other details of the structure of the station 3 will be given in the following description with reference to FIGS. 6 to 10.

The welding station 4 includes a clamping and welding system for the filled bag 5 including two jaws 16 movable relatively under the action of a jack 17 borne by the base 1. Details on this station will be given with reference to FIGS. 12, 13 and 14.

The transfer of the full bag 5 from the station 3 to the station 4 is ensured by two oppositely acting strips 18 pinching and holding the full bag, these strips being connected to the carriage 6 by linkrods 19 and moved by a jack 20 fixed to the carriage 6.

Figure 4:
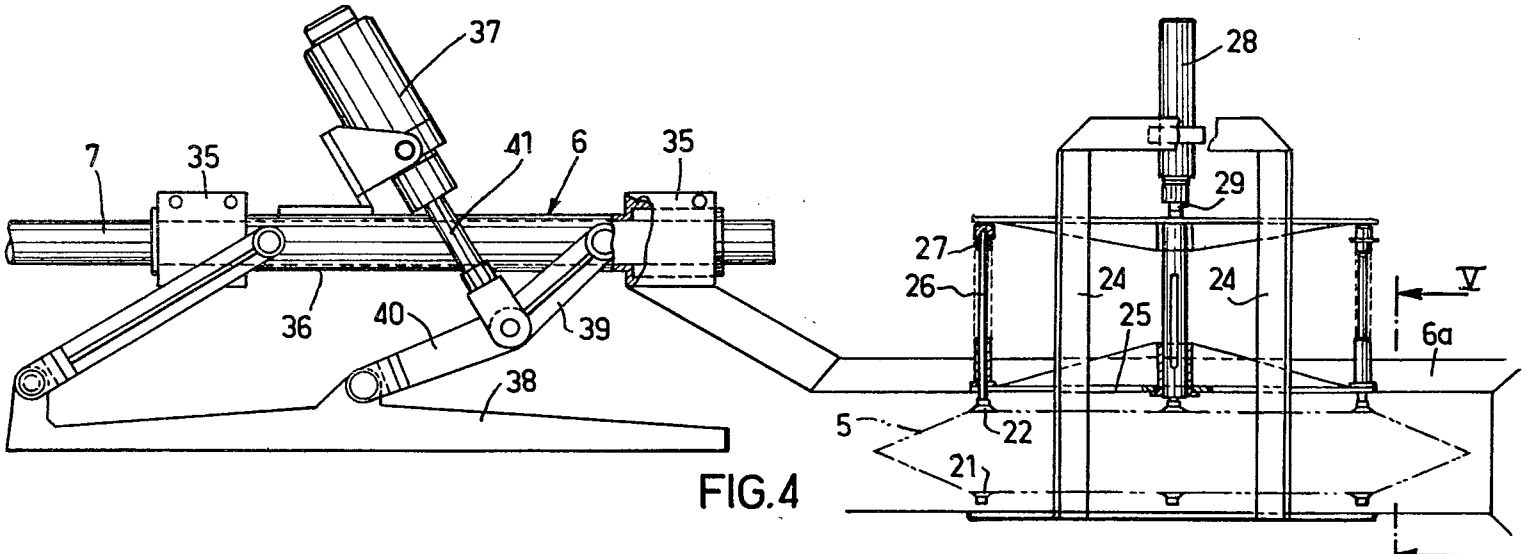
FIG. 4 is a partial view from above of the gripping and opening station of the bags and of the horizontal transfer carriage for the bags from one station to the next.
Figure 9:
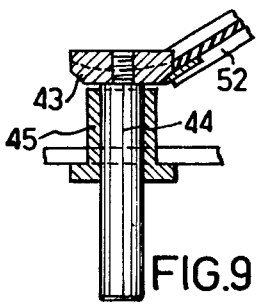
FIG. 9 shows a sectional view along the line IX—IX of FIG. 6.
Figure 5:
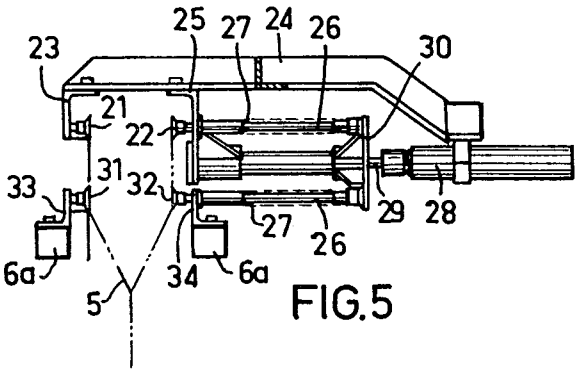
FIG. 5 is a sectional view along the line V—V of the device of FIG. 4.

Reference will now be made to FIGS. 4 and 5 in order to describe in more detail the gripping and opening station 2 of the bag 5.

This station comprises a first series of upper suckers 21 and 22 arranged facing one another and constituted by suction discs connected by flexible pipes (not shown) to a source of vacuum.

A part 21 of these suckers is fixed and mounted on an angle iron 23 fixed to the end of the arm 24 fast to the base 1.

The opposite by acting suckers 22 are mounted to slide in an angle iron 25 also fixed on the arms 24.

The suckers 22 are fixed to the end of hollow rods 26 connected by flexible pipes (not shown) to a source of vacuum. The sliding of the hollow rods 26 in the angle iron is effected against return springs 27 under the effect of a jack 28 fast to the base 1 of which the rod 29 is fast to a thrust plate 30 acting on the rods 26 to bring together the suckers 22 and the suckers 21.

The station 2 comprises a second series of lower suckers 31, 32 arranged facing one another and constituted also by suction discs connected by flexible pipes (not shown) to the vacuum source.

A part 31 of these suckers is mounted fixed on the fork **6*a* through an angle iron 33**.

The opposing suckers 32 are identical with the upper suckers 22 and are mounted to slide in an angle iron 34 fixed to the other arm of the fork **6*a***.

They also comprise a hollow rod 26, a return spring 27 and are pushed by the plate 30.

FIG. 4 shows also partially the carriage 6 for transferring bags from one station to the next.

This carriage 6 is constituted by two symmetrical parts, only one being shown in FIG. 4. Each half carriage comprises two bushes 35 coupled by a sleeve 36 on which are fixed a jack 37 and control linkrods for a blade 38 arranged to grip the bag 5 and to hold it suspended. One of the linkrods comprises two parts 39 and 40 pivoted on an axle to which the end of the rod 41 of the jack 37 is fastened. In FIG. 4 the means for moving the carriage 6 in horizontal translation are not shown.

The structure of the bagging station 3 will now be described in more detail with reference to FIGS. 6 to 10.

This station 3 is situated vertically aligned with the chute 10 which is constituted by a flexible material.

Figure 6:
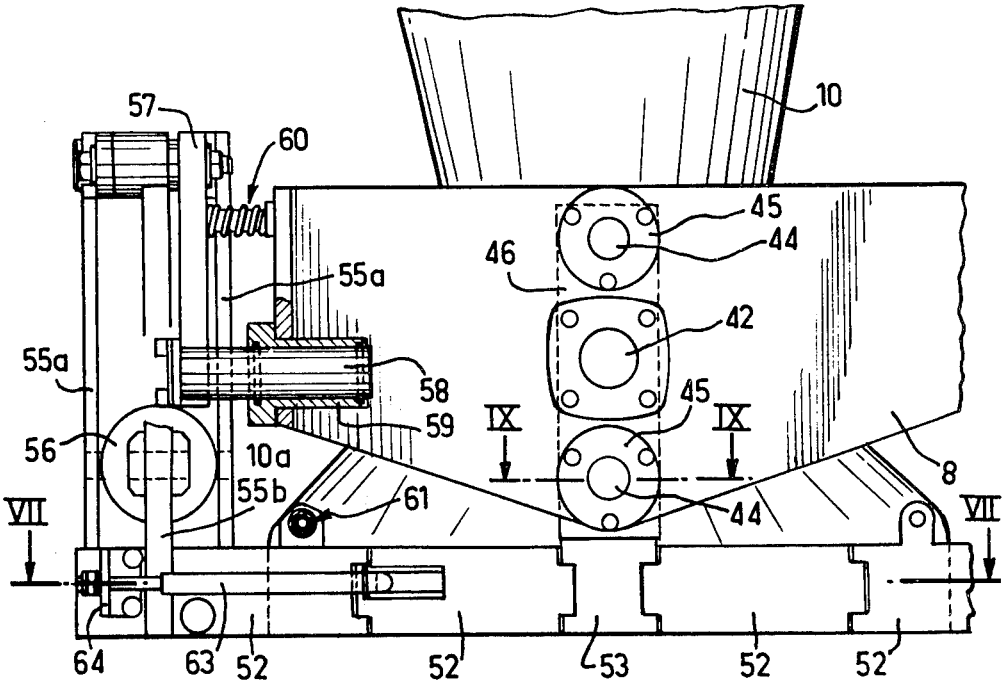
FIG. 6 shows a partial view in front elevation of the members for holding in sealed open position the lips of the bag and the lips of the chute 10.

Referring to FIG. 6, the chute 10 narrows progressively down to the level of the box-form frame 8 and then widens at **10*a* to terminate in a horizontal mouth enclosed by the system for applying the lips of a bag 5 against the outer size of the lips of the chute 10*a***.

The box-frame 8 is intended to bear members to open the chute 10. These members comprises two symmetrically horizontal jacks 42 arranged on both sides of the box 8. Each jack 42 drives through its rod two separating parts 43 (FIG. 9) fast to the chute 10, the parts 43 being borne by the guide rods 43 sliding in the bushes 45 fixed to the frame 8. The walls of the chute 10, are constituted by a double thickness so as to enclose the parts 43 coupled by a connecting plate 46 fixed to the end of the rod of the jack 42.

Figure 10:
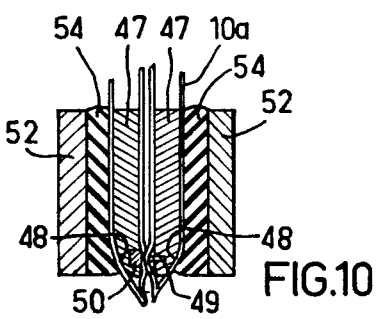
FIG. 10 is a sectional view along the line X—X of the device of FIG. 7.

FIG. 10 shows the structure of the lower part **10*a*** of the chute.

In the thickness of the double wall of the facing lips are inserted plates 47 whose lower outer edges 48 are rounded. In order to have well-sealed obturation of the chute, inside the double wall is provided a knife 49 fast to one of the plates 47 cooperating with an elastic lip 50 fast to the facing plate 47.

Figure 7:
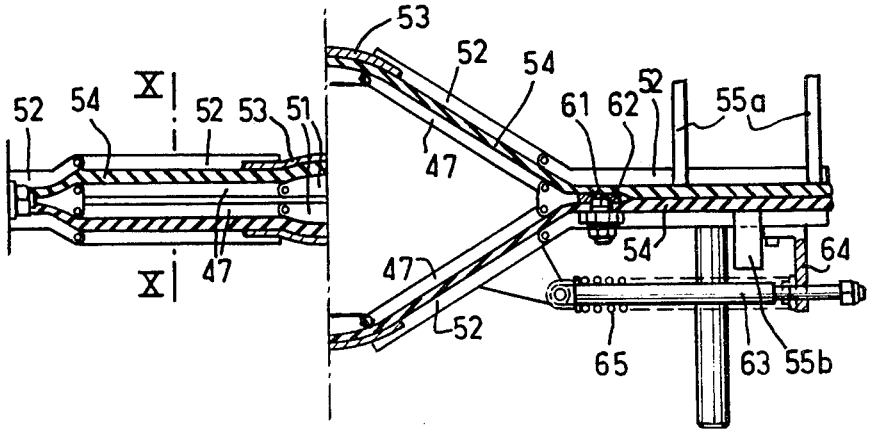
FIG. 7 shows a sectional view along the line VII—VII of the device of FIG. 6.

As can be seen in FIG. 7, the plates 47 form a pivoted system in several parts coupled by connecting parts 51, the double walls of the chute **10*a* not being shown in this FIG. 7**.

In FIG. 10, the plates 47 are held in the position of obturating the chute by the pressure exerted by the jacks 45, through the part 46 pivoted on 47.

A rubber strip 54 is glued to the inner surface of the plates 52.

Figure 8:
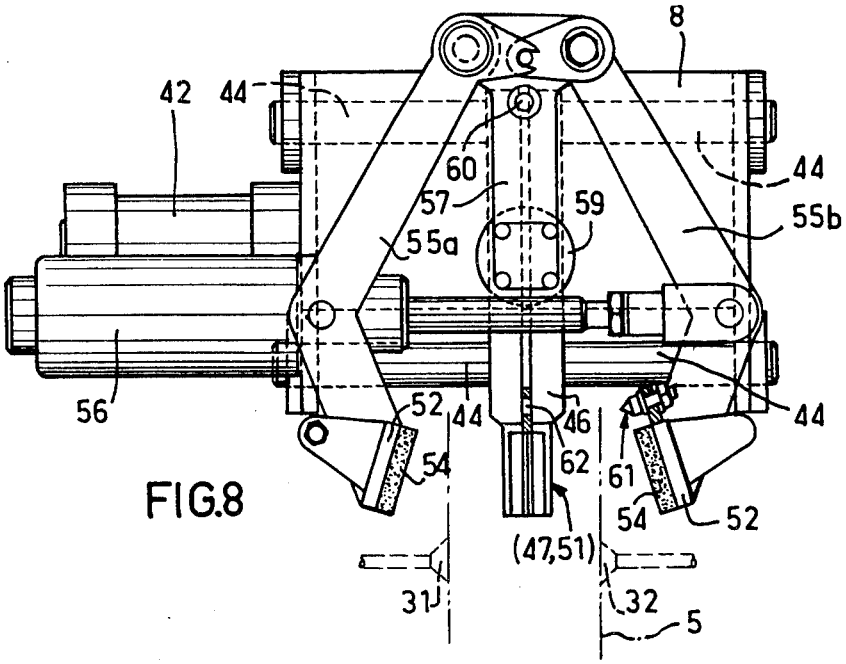
FIG. 8 shows a view from the left of the device of FIG. 6.

The latter can be brought together or spaced apart from one another to apply the lips of a bag 5 against the outer surface of the lips of the chute **10*a* due to the system shown in FIG. 8. In this Figure, only the inner armature (46, 47, 51) of the chute 10*a*** has been shown with the exclusion of the double walls within the thickness of which these armatures are arranged.

The plates 52 are fixed to the end of bent levers **55*a* and 55*b* pivoted at their other end to the frame 8**. The levers 55*a* and 55*b* are actuated by a jack 56 whose body is fast to one of the levers 55*a* and the rod fast to the other lever 55*b*. Two systems of this type arranged symmetrically on both sides of the frame 8 exist. In FIG. 6, only one of these systems has been shown to simplify the drawing.

The systems constituted by the levers 55*a*, 55*b* and jacks 56 are fixed to the frame 8 by two parts 57 bearing a pivot 58 sliding in the sleeve 59 fast to the frame 8 and associated with a spring-wedging system 60.

There is also provided a positioning system constituted by a centering pin 61 fixed to one of the plates 52 and cooperating with a hole 62 formed in a lug fast to the inner armature of the chute 10*a*.

The guidance of certain of the plates 52 on the opening of the lips of the chute 10*a* is ensured (FIGS. 6, 7) by rods 63 pivoted on the plates 52, sliding in the angle iron 64 and recalled by a spring 65.

In FIGS. 6 and 7 there is only shown, in order to simplify the drawing, a single guide rod 63, although actually there are four of them for the four plates 52 arranged in a diamond on the opening of the lips of the chute (right-hand half portion of FIG. 7).

Figure 11:
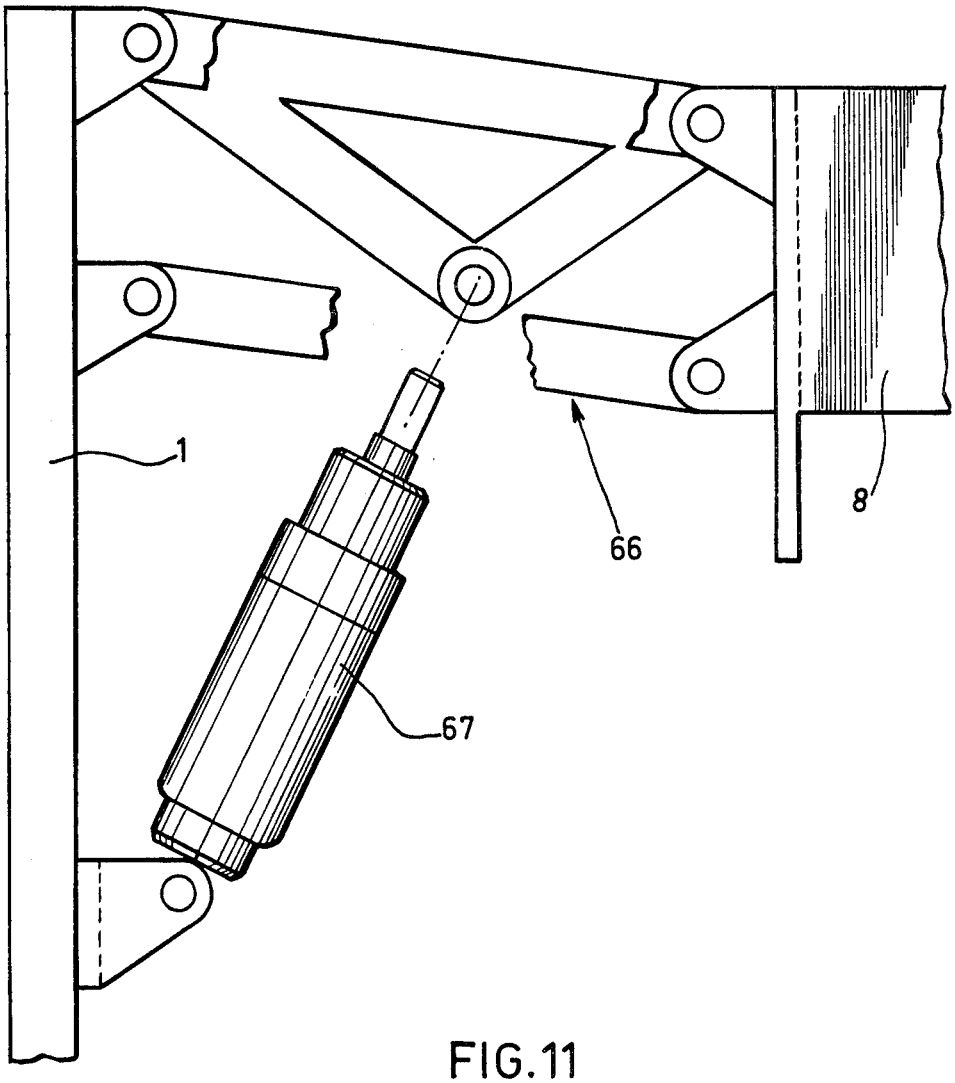
FIG. 11 is a partial view of the linking system between the base of the machine and the opening system of the chute.

The box 8 is mounted vertically movable and, to this end, is connected to the base 1 of the machine through a pivoted parallelogram system 66 (FIG. 11) actuated by a jack 67.

Figure 14:
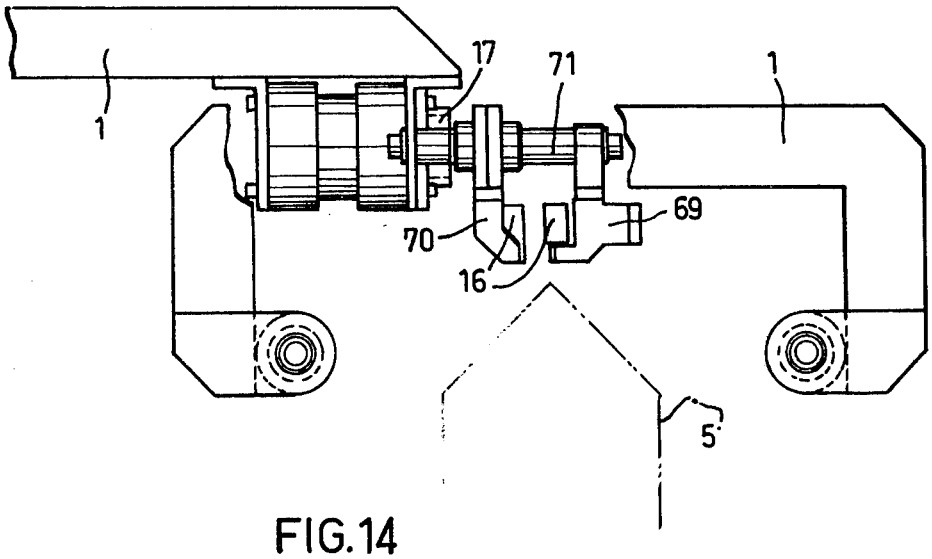
FIG. 14 is a left-hand view of the device of FIG. 12.
Figure 12:
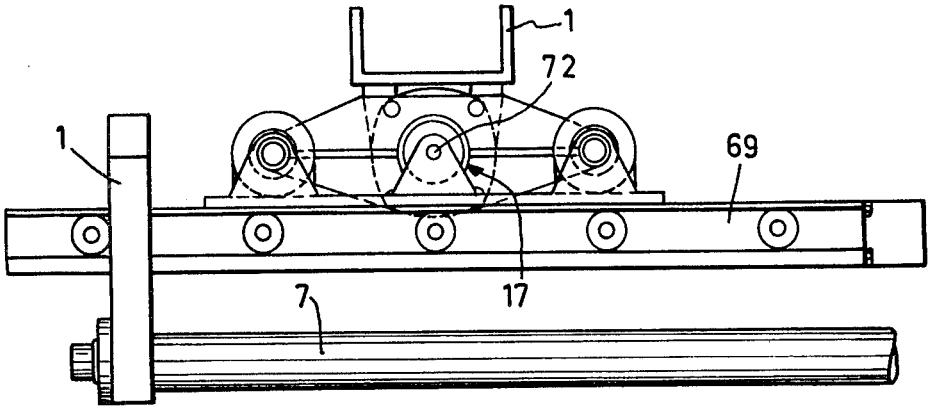
FIG. 12 is a diagrammatic view in front elevation of the welding members.
Figure 13:
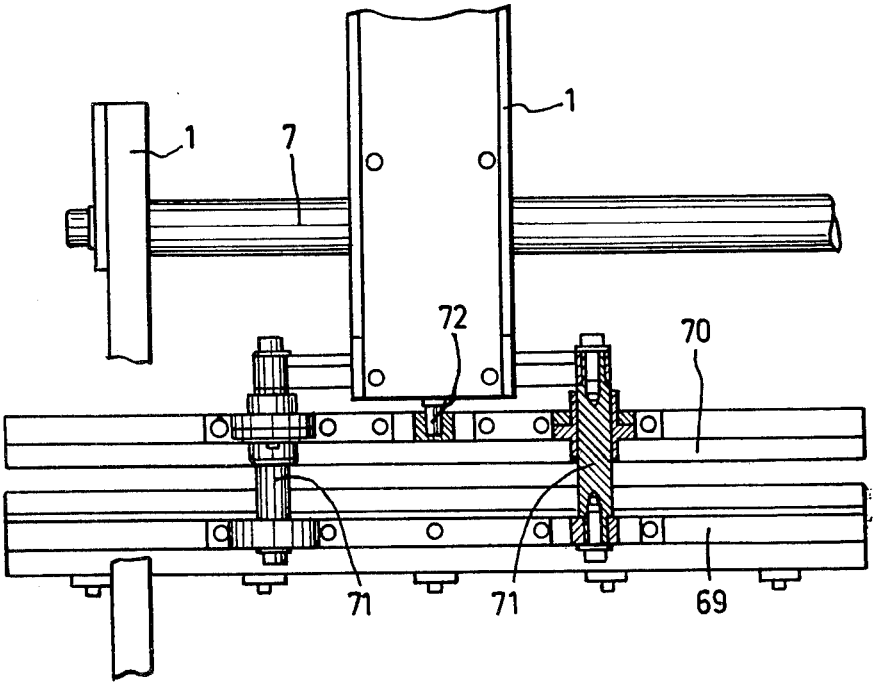
FIG. 13 is a view from above of the device of FIG. 12.

The welding station 4 will now be described in more detail with reference to FIGS. 12, 13 and 14.

The welding members are constituted by two conventional welding jaws 16 borne by supports 69 and 70 themselves mounted on a system enabling them to be brought together or moved apart. One of the supports 69 is mounted fixed to the end of slides 71 fast to the base 1 of the machine whilst the other support 70 is slideably mounted on the slideways 71 and is moved under the effect of the rod 72 of the jack 17.

The operation of the machine that has just been described is as follows:

The positioning of an empty bag 5 is done manually by an operator who places a bag vertically, mouth closed, the valve 15 facing the aspiration orifice. The operator presents the lips of the bag within the space between the series of suckers 21, 22 and 31, 32, the carriage 6 being in the position shown in FIG. 1. The machine is then started.

The rod 29 of the jack 28 is extended. The plate 30 pushes back the suckers 22 and 32 against springs 27 in the direction of the suckers 21, 31.

At the stroke end of the jack 28, the suckers 21, 22, 31 and 32 suck the walls of the bag 5, then the pressure in the jack 28 is released and the springs 27 bring back the suckers 22, 32 into their initial position (FIGS. 4 and 5), which opens the mouth of the bag 5.

Assuming that the bagging station 3 is free, the bag 5 is then transferred to this station by the translation of the carriage 6 which will occupy the position shown in FIG. 2. Prior to this movement, the suckers 21 and 22 cease to suck, the bag 5 being held by only the lower suckers 31 and 32 which are moved with the carriage 6 (the suckers 32 not being physically connected to the thrust plate 30).

Once at the bagging station 3, the bag 5 will be threaded onto the end of the chute 10 in the following way.

The jacks 56 are actuated so that the members 52, 54 are separated (FIG. 8), the jacks 42 being held such that the lips of the chute 10*a* are closed (parts 47 in the position shown at the left-hand portion of FIG. 7 and in FIG. 8).

Then, under the effect of the jack 67 (FIG. 11), the box 8 is lowered so that the lips of the chute 10*a* are engaged in the mouth of the bag 5 as shown in FIG. 8.

Then,simultaneously, the rods of the jacks 42 and 56 are retracted so as to imprison the bag in open position between the plates 47 and 52. In the right hand portion of FIG. 7 are shown the plates 47 and 52 in their sandwich gripping position made fluid-tight due to the rubber 54 of the bag 5 which is not however shown in this Figure in the same way as the double walls of the chute 10*a*.

The bagging operation then commences. The amount of product measured out or weighed out is poured into the chute 10 and fills the bag 5 whose sides are held as a sandwich by the plates 11 due to the jacks 12. The vibrator fast to one of the plates 11 is started although the vacuum is formed in the pipe 14 so as to suck through the coupling 13 and the valve 15 the air carried into the bag by the product. The latter is thus compacted and deaerated and fills practically the whole bag.

Once the bag has been filled, the rod of the jacks 42 is extended to obturate the chute 10*a* in sealed manner (FIG. 10 and left-hand part of FIG. 7).

The rods of the jacks 20 of the carriage 6 which, meanwhile, has returned into its position of FIG. 1, are extended in order to seize by clamping the bag through the blades 18.

Then, the rods of the jacks 56 and 67 are extended in order to free and disengage the bag from the chute, the bag remains suspended by the blades 18.

The plates 11 are separated and the carriage 6 is moved leftwards to transfer the full bag to the welding station 4 (FIG. 2).

At this station, the welding jaws 16 are brought together by means of the jacks 17 to form a weld line obturating the mouth of the bag.

Finally, the bag 5 is released and removed and the carriage 6 comes back to its initial position (FIG. 3).

In the course of transferring the full bag from the bagging station 3 to the welding station 4, another bag 5 taken up by the station 2 is transferred to the baging station (FIGS. 1 and 2).

The sequencing of the various movements of the rods of the jacks of the various stations is carried out automatically in known manner, notably by means of stroke end sensors and time delay devices.

The only manual control is that of the jack 28 to initiate a cycle of the machine, this jack being arranged to actuate the bringing together of the suckers for taking up an empty bag at the station 2.

It is to be noted that with such a machine the welding of the lips of the bag is carried out under excellent conditions due to the fact that the areas of the bag where the welding must be effected are entirely preserved from all contact with the product in the course of bagging, these areas being taken as a sandwich in sealed manner between the plates 47 and 52.

Of course, the invention is not limited to the embodiment illustrated and described above but on the contrary covers all modifications thereof. Thus, for the welding station there may be substituted a station for sewing the bags which can be of plastics material, of paper or a composite, the general structure of the machine remaining unchanged.

I claim:

1. Bagging machine for packaging powdery materials into bags of the "open mouth" type, said machine comprising a bag-gripping and opening station of the sucker type adapted to be connected to a source of vacuum, a bag-filling station comprising an inlet chute for the substance connected to a measuring and/or weighing means, means for opening and closing the orifice of the chute, means for inserting this orifice into the open mouth of the bag and to apply the lips of the latter into sealed contact against said chute, means for compacting the substance being filled into the bags and means for sucking out the air contained inside the bags being filled, a station for closing the bags by welding and/or sewing, means for holding the bags by suspension and for successively transferring them from one station to the next and means for automatically synchronizing and sequencing the various movements and operations at the various stations.

2. Bagging machine according to claim 1, wherein the means for holding and transferring the bags successively from one station to the next are constituted by a carriage movable alternately in horizontal translation and comprising, on the one hand, first members for gripping and opening the empty bags and, on the other hand, second members for gripping and holding full bags, said first members moving between the station for gripping the bags and the filling station and said second members moving between the filling station and the bag-closing station and means for driving the carriage in translation.

3. Bagging machine according to claim 2, wherein said first members for seizing and opening the bags are constituted by two series of suckers arranged in opposition and connected to a source of vacuum, one of the series being capable of being brought together or of being separated from each other under the effect of a jack or the like.

4. Bagging machine according to claim 2, wherein said second members for seizing and holding the full bags are constituted by two opposing blades capable of clamping the mouth of the bags under the effect of jacks or the like borne by the carriage.

5. Bagging machine according to claim 3, wherein the station for seizing and opening the empty bags comprises, in addition to said suckers borne by the translation carriage, a second set of suckers of which certain are fixed and others are capable of being brought together or separated from the first under the effect of a jack or the like fixed on the base of the bagging machine, said jack being capable of moving said series of movable suckers of the carriage when these suckers are at the station for seizing and opening the empty bags.

6. Bagging machine according to claim 1, wherein said means for opening and closing the chute for inserting its orifice into the open mouth of the empty bags and for applying the lips of the latter against the chute are constituted by a pivoted armature fast to the chute and actuated by jacks or the like borne by a box movable vertically so as to insert the chute into a bag or to extract it therefrom, and by an engirdling system formed by pivoted plates capable of taking the end of the chute and the mouth of the bag as a sandwich and movable under the effect of the jacks or the like borne by said base.

7. Bagging machine according to claim 1, wherein said means for compacting the product being filled into the bags are constituted by two movable plates capable of taking the bag being filled as a sandwich, one at least of the plates being equipped with a vibrator.

8. Bagging machine according to claim 7, wherein the means for sucking out the air contained inside the bags being filled are constituted by a suction orifice formed in the wall of one of the plates and connected to a vacuum source, said orifice being arranged so as to be facing a valve applied to one of the walls of the bags.

9. Bagging machine according to claim 1, wherein the bag-closing station comprises two welding jaws, adapted, under the effect of a jack or the like, to grip the mouth of the bags to form a continuous weld line.

10. Bagging machine according to claim 6, wherein the lower end of the chute is sealingly obturatable by means of a knife fast to a portion of said pivoted armature and cooperating with an elastic lip fast to the other portion of the armature.

* * * * *